US005564711A

United States Patent [19]

Scheie

[11] Patent Number: 5,564,711

[45] Date of Patent: Oct. 15, 1996

[54] MULTIPURPOSE SPORTS GOAL

[75] Inventor: Carl E. Scheie, Libertyville, Ill.

[73] Assignee: Wilson Sporting Goods Co., Chicago, Ill.

[21] Appl. No.: 500,549

[22] Filed: Jul. 11, 1995

[51] Int. Cl.[6] ..... A63B 63/04

[52] U.S. Cl. ..... 273/400

[58] Field of Search ..... 273/400, 558, 273/127 R, 127 A, 127 B, 127 C, 127 D

[56] References Cited

U.S. PATENT DOCUMENTS

| | | | |
|---|---|---|---|
| 3,399,889 | 9/1968 | Harry | 273/1.5 R |
| 3,860,240 | 1/1975 | Koch | 273/411 |
| 4,083,561 | 4/1978 | Daffer, Jr. | 273/127 B X |
| 4,457,513 | 7/1984 | Thompson | 273/411 |
| 5,197,744 | 3/1993 | Nanau | 273/396 |
| 5,249,796 | 10/1993 | Silvi | 273/127 R X |

*Primary Examiner*—William H. Grieb

[57] ABSTRACT

A multipurpose sports goal assembly can be used for a variety of sports including football and soccer. The goal assembly includes a lower goal portion and a pair of telescoping upright poles. The poles are retracted when the goal is used in soccer, and the poles are extended when the goal is used in football. A net is attached to the lower goal assembly and is adapted to be releasably attached to the upright poles when the poles are extended. The structural members which form the goal assembly are removably connected so that the goal assembly can be disassembled and stored in a compact package.

8 Claims, 2 Drawing Sheets

FIG. 2
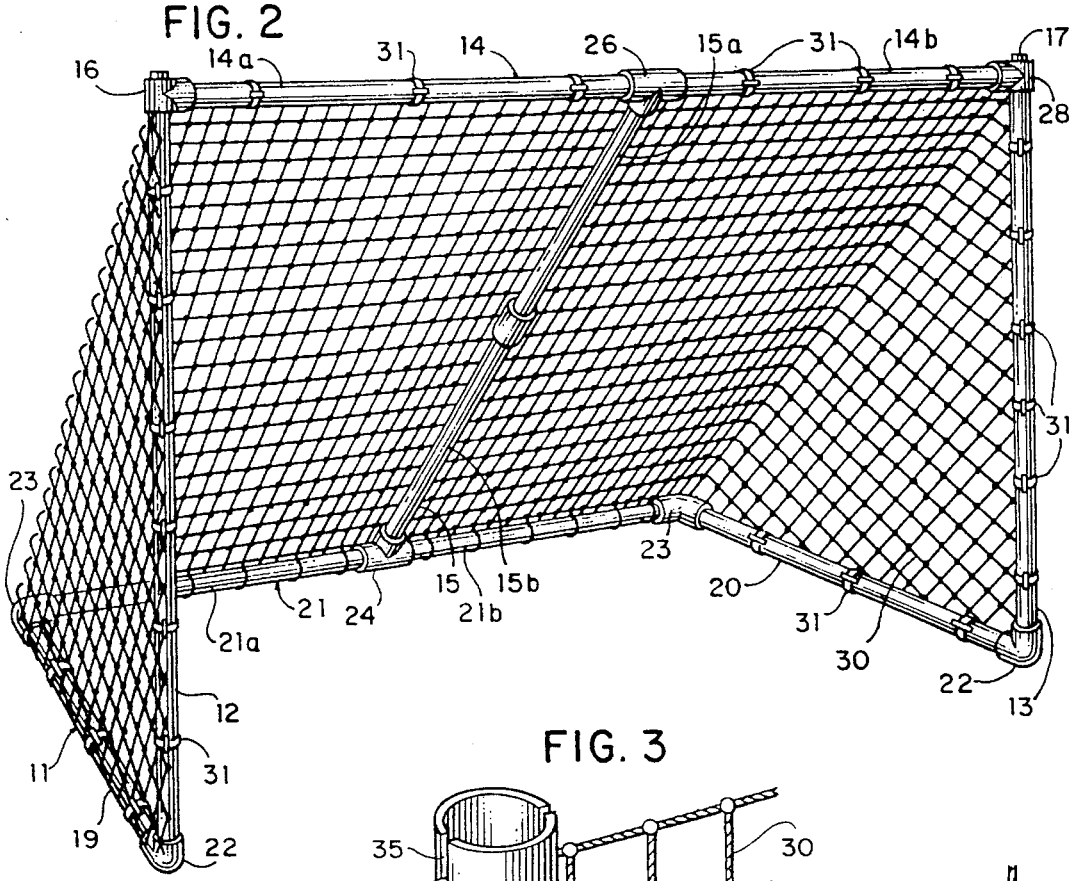
FIG. 3
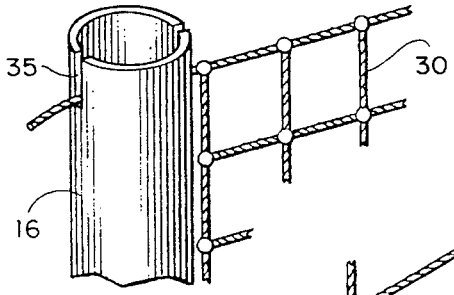
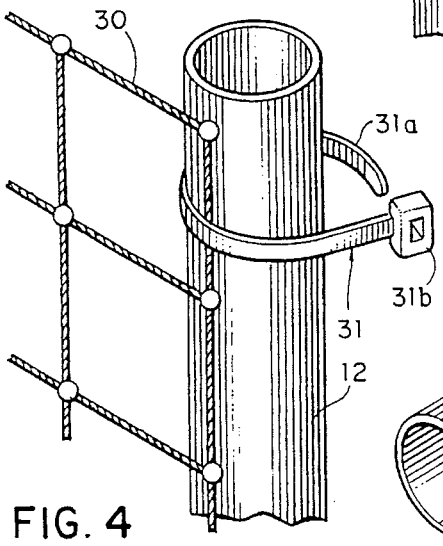
FIG. 4
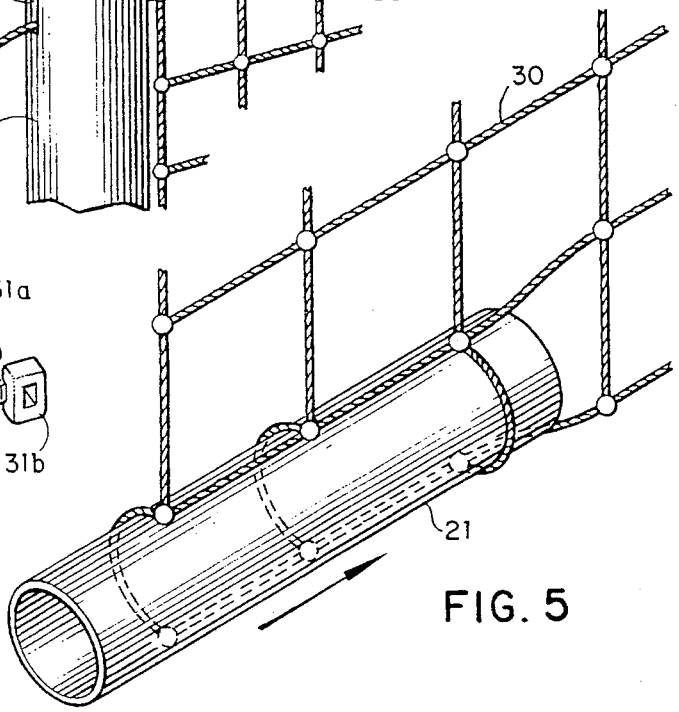
FIG. 5

MULTIPURPOSE SPORTS GOAL

BACKGROUND OF THE INVENTION

This invention relates to a multipurpose sports goal assembly which is particularly useful in youth sports.

Children enjoy playing a variety of sports which utilize a goal, for example, football, soccer, lacrosse, field hockey, etc. A goal which can be used in a variety of sports would eliminate the need for acquiring and setting up a separate goal for each sport.

U.S. Pat. No. 5,249,796 describes a convertible sports goal apparatus which can be used as a goal for football, soccer, and other sports. However, other than connectors 30, the patent does not describe the structural members as being removably connected so that the goal can be disassembled and stored in a compact package. Even if the members could be disconnected, the lengths of many of the members are too long for compact storage. Although the goal includes a net for use in soccer, there is no net for attaching to the extended upright posts when the goal is used in football.

The invention provides a multipurpose sports goal which can be quickly and easily assembled and disassembled. When the goal is disassembled, no individual structural member exceeds 48 inches in length, and the components of the goal can be stored in a compact package. A net is attached to the soccer portion of the goal, and when the football uprights are extended, the net can be removably attached to the upper ends of the uprights.

DESCRIPTION OF THE DRAWING

The invention will be explained in conjunction with an illustrative embodiment shown in the accompanying drawings, in which

FIG. 2 is similar to FIG. 1 with the upright posts retracted;

FIG. 3 is an enlarged fragmentary perspective view showing the attachment of the net to one of the upright posts;

FIG. 4 is an enlarged fragmentary perspective view showing the attachment of the net to one of the side posts; and FIG. 5 is an enlarged fragmentary perspective view showing the attachment of the net to the bottom cross member.

DESCRIPTION OF SPECIFIC EMBODIMENT

Figure 1:
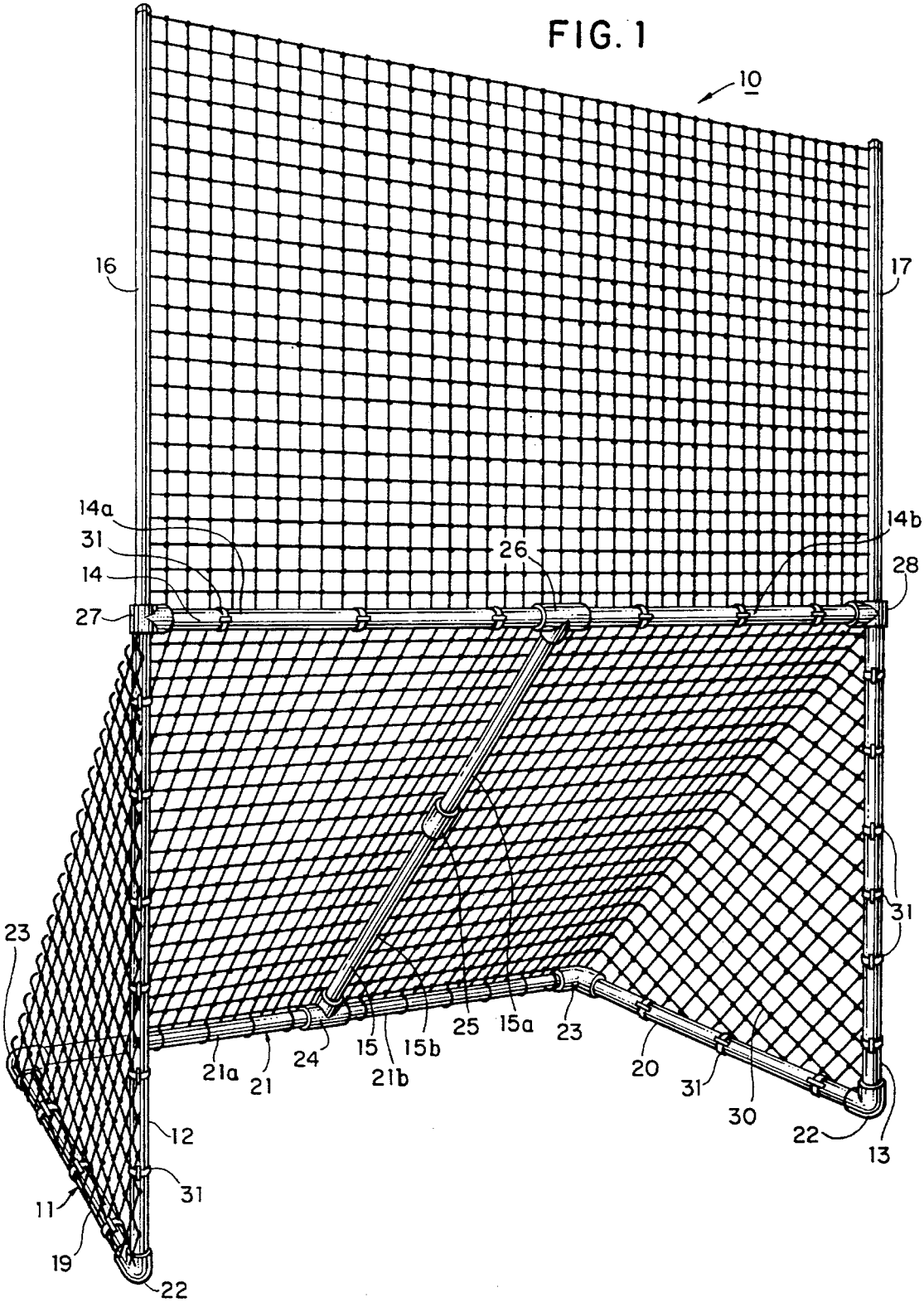
FIG. 1 is a perspective view of a goal assembly formed in accordance with the invention with the upright posts extended.

A multipurpose sports goal assembly 10 includes a base 11 for supporting the goal on a playing surface, a pair of vertical side posts 12 and 13, a center cross member 14, and a back support member 15. A pair of upright poles 16 and 17 are telescopingly received in the sides posts.

The base 11 is formed by a pair of parallel bottom side members 19 and 20 which extend from the lower ends of the side posts and a bottom cross member 21. The front ends of the bottom side members 19 and 20 are removably connected to the lower ends of the side posts by elbow connectors 22. The back ends of the bottom side members 19 and 20 are removably connected to the bottom cross member 21 by elbow connectors 23.

The bottom cross member 21 is preferably formed from a pair of tubes 21*a* and 21*b* which are removably connected to a T connector 24. The bottom cross member can thereby be stored as two separate parts in order to reduce the length of the cross member.

The back support member 15 is removably connected to the bottom cross members 21*a* and 21*b* by the T connector 24. The back support member is also preferably formed from a pair of tubes 15*a* and 15*b* which are removably connected by a tubular connector 25. The connector 25 can be either a bell connector which is formed by flaring the end of one of the tubes 15*a* or 15*b*, or the connector can be formed separately.

The center cross member 14 is also preferably formed from a pair of tubes 14*a* and 14*b* which are removably connected by a T connector 26. The T connector 26 is also removably connected to the back support member 15. The outside ends of the center cross member are removably connected to the side posts 12 and 13 by T connectors 27 and 28.

The upper ends of the side posts 12 and 13 extend through the top openings of the T connectors 27 and 28, and the upright poles 16 and 17 extend upwardly from the side posts. The upright poles can be releasably locked in the extended position illustrated in FIG. 1 by conventional locking sleeves, pushbuttons, or the like.

A net 30 is attached to the base 11, the side post 12 and 13, and the center cross member 14 to prevent a ball from passing through the space between the base and the center cross member. The net can also be removably attached to the upper ends of the upright poles 16 and 17 when the upright poles are extended to prevent a ball from passing between the uprights.

In the particular embodiment illustrated, the bottom edge of the net is attached to the bottom cross tubes 21*a* and 21*b* by removing the tubes from the connectors 23 and 24 and threading the tubes through the mesh openings of the net as shown in FIG. 5. For example, tubes can pass through every third opening in the net.

The net is attached to the center cross member 14 and the side posts 12 and 13 by plastic ties 31 (see also FIG. 4). The ties are conventional plastic ties which include a ratchet end 31*a* and a slotted end 31*b*. The ratchet end is inserted through the slotted end to form a loop, and teeth on the ratchet end prevent that end from being withdrawn from the slotted end. If desired, the net can also be attached to the bottom side members 19 and 20 by plastic ties.

The upper end of each of the upright poles 16 and 17 is provided with a slot 35 (FIG. 3). The top edge of the net can be removably attached to the upright poles by inserting the cord which forms the net into the slots. The tension of the upper portion of the net can be adjusted as desired by selecting the end of an appropriate mesh opening for insertion into each of the slots 35.

The base 11, side posts 12 and 13, and center cross member 14 form a goal which can be used for soccer, field hockey, lacrosse, etc. (collectively referred to as a "soccer goal"). The net 30 will catch and retain balls which are hit into the goal. When the goal is used for soccer, the upright poles 16 and 17 are retracted into the side posts 12 and 13 so that the upper ends of the uprights are adjacent the upper ends of the side posts. The upper portion of the net can be detached from the upright poles and draped over the lower portion of the net. If desired, however, the net can remain attached to the retracted upright poles.

When the goal is used for football, the upright poles are locked in their extended positions, and the net is attached to the upper ends of the upright. It will be understood, however, that the goal can also be used without attaching the net to the uprights.

The structural members of the goal are preferably formed from PVC or other suitable plastic tubular pipe stock. The connectors can also be formed from PVC. The plastic tubes are retained within the connectors by a friction fit. The goal can therefore be quickly and easily assembled or disassembled by inserting the tubes into, or removing the tubes from, the connectors.

The longer structural parts are the bottom cross member 21 and the center cross bar 14. By forming those parts from two pieces, the maximum length of the disassembled parts is reduced. In the preferred embodiment of the goal, none of the tubes is longer than 48 inches. The disassembled goal can therefore be packaged in a carton which is no more than 48 inches long, which is a conventional maximum length for packages which are displayed on retail store shelves. The relatively short maximum length also permits the goal to be stored in a compact configuration after use.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A sports goal assembly comprising:

a base for supporting the goal assembly on a playing surface, the base having a pair of sides and a back, a pair of side tubes extending upwardly from the sides of the base, a cross bar extending between the side tubes, an upright tube telescopingly received in each of the side tubes from each of the upright tubes having an upper end and being movable between a retracted position in which the upright tube is telescoped within a side tube and an extended position in which the upright tube extends upwardly from the side tube and the upper end is spaced above the cross bar, a net attached to the base, the side tubes, and the cross bar and adapted to be attached to the upright tubes when the upright tubes are in their extended position, the sides of the base extending generally parallel from the side tubes and the back of the base extending generally perpendicularly to the sides of the base, and a back support member which extends between the middle of the back of the base and the middle of the cross bar.

2. The goal assembly of claim 1 in which the upper end of each of the upright tubes is provided with a slot into which the net is inserted.

3. The goal assembly of claim 1 including plastic tie loops on the side tubes for connecting the net to the side tubes.

4. The goal assembly of claim 1 including plastic tie loops on the base for connecting the net to the base.

5. The goal assembly of claim 1 in which the back of the base comprises a pair of tubes and a connector which removably connects the tubes, each of the tubes being threaded through the net.

6. A sports goal assembly comprising:

a pair of parallel bottom side members having front and rear ends and a pair of bottom cross members which extend generally perpendicularly between the rear ends of the bottom side members for supporting the goal assembly on a playing surface, a pair of elbow connectors removably connecting the rear ends of the bottom side members and the bottom cross members, a T connector removably connecting the bottom cross members, a pair of side members extending upwardly from the front ends of the bottom side members and having top and bottom ends, a pair of elbow connectors removably connecting the front ends of the bottom side members and the bottom ends of the side members, a pair of center cross members extending between the upper ends of the side members, a pair of T connectors removably connecting the cross members and the side members, a T connector removably connecting the center cross members, a back support member extending between the T connector for the bottom cross members and the T connector for the center cross members and being removably connected thereto, an upright member telescopingly received in each of the side members, each of the upright members having an upper end and being movable between a retracted position in which the upright members telescope within the side member and an extended position in which the upright member extends upwardly from the side member and the upper end is spaced above the center cross members, and a net attached to at least some of said members.

7. The goal assembly of claim 6 in which the net is removably attached to the upper ends of the upright members.

8. The goal assembly of claim 6 in which each of the bottom cross member and the center cross member is formed from two parts which are removably connected, and all of said members are no more than 48 inches long.

* * * * *